United States Patent [19]

Krembel, Jr.

[11] 4,314,505

[45] Feb. 9, 1982

[54] ROTARY WHEEL TYPE MARKING HEAD

[75] Inventor: Frank Krembel, Jr., St. Clair Shores, Mich.

[73] Assignee: Columbia Marking Tools, Inc., Detroit, Mich.

[21] Appl. No.: 186,343

[22] Filed: Sep. 11, 1980

Related U.S. Application Data

[63] Continuation of Ser. No. 951,252, Nov. 16, 1978, abandoned.

[51] Int. Cl.[3] ..... B41J 1/44

[52] U.S. Cl. ..... 101/85; 101/18; 101/29; 101/110

[58] Field of Search ..... 101/18, 29, 78, 79, 101/80, 85, 86, 45, 95, 96, 99, 110

[56] References Cited

U.S. PATENT DOCUMENTS

| | | | |
|---|---|---|---|
| 1,062,183 | 5/1973 | Martin | 101/86 |
| 1,385,835 | 7/1921 | Kern | 101/85 |
| 1,407,769 | 2/1922 | Premo | 101/18 |
| 3,421,436 | 1/1969 | Patterson et al. | 101/45 |
| 3,482,512 | 12/1969 | Jung | 101/85 X |
| 3,541,954 | 11/1970 | Speicher et al. | 101/95 |
| 3,840,104 | 10/1974 | Groppini | 101/18 X |

*Primary Examiner*—Edward M. Coven

*Attorney, Agent, or Firm*—Barnes, Kisselle, Raisch & Choate

[57] ABSTRACT

In a marking head having one or more marking wheels each rotated step-wise by a reciprocating actuating pawl engaged in successive circumferentially arranged recesses on the wheel and secured in marking position by a retainer pawl engaged under a spring bias successively in the recesses, improved structure wherein the recesses and retainer pawl have circumferentially spaced apart interengaged cam surfaces which permit circumferential shifting of the wheel induced by surface irregularities in a workpiece being marked and facilitate spring return of the wheel to centered position after the marking, each recess having a flat bottom engaged by a blunt flat end face of the actuating pawl, each recess having a flat rearwardly facing shoulder adjacent its forward cam surface engaged by a blunt forward face of the actuating pawl.

22 Claims, 8 Drawing Figures

FIG. 3
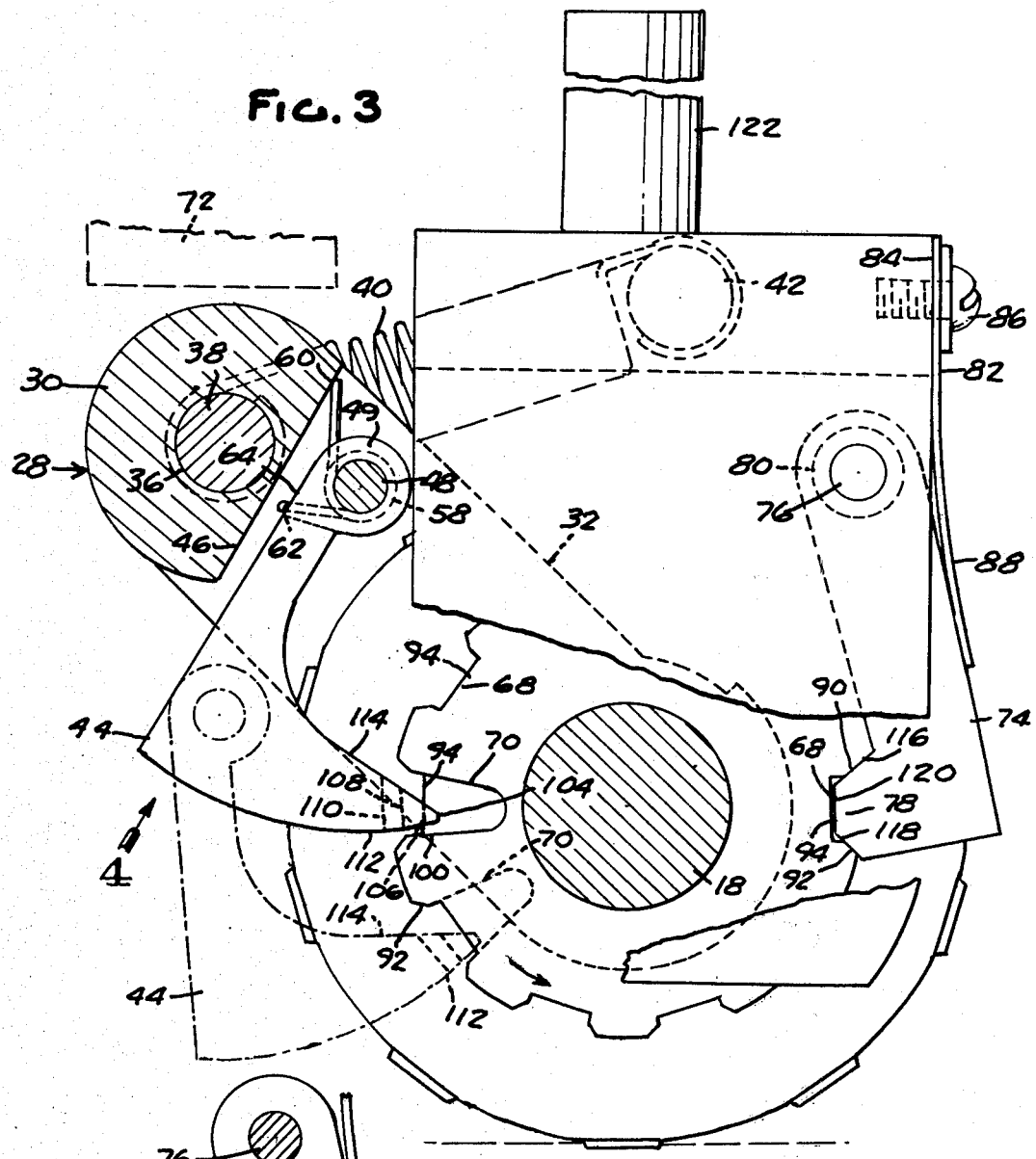
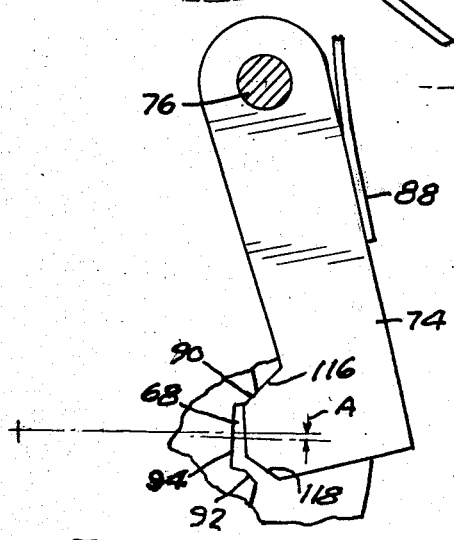
FIG. 7
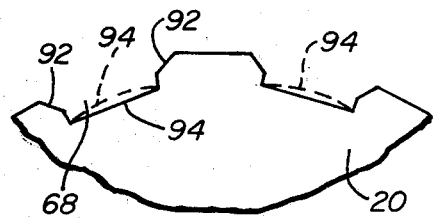
FIG. 8

ROTARY WHEEL TYPE MARKING HEAD

This is a continuation of application Ser. No. 951,252, filed Nov. 16, 1978 and abandoned in favor of this application.

This invention relates to marking heads of the type having one or more marking wheels which are rotated intermittently step-wise by a reciprocating actuating pawl which in successive movements in the same direction engages in successive, circumferentially arrayed recesses in the wheel. At the end of each rotative step a retaining pawl engages in one of the recesses under a spring bias to retain the wheel circumferentially stationary with a symbol or a marking zone thereon centered with respect to an area of a workpiece to be marked. Typically, such marking heads have several wheels coaxially mounted and provided with a series of numbers for serially numbering a succession of workpieces.

In a typical conventional marking head the actuating pawl is pointed and during its wheel advancing step the point nests within a radial pocket forming part of the recess. Also, in such a marking head the retainer pawl and recess have substantially radial shoulders which interengage to prevent retrograde turning of the wheel to a location out of alignment with the area of a workpiece to be marked during retraction of the actuating pawl. These structural features not infrequently give rise to breakage and malfunctions as is set forth below.

Marking heads very commonly are used for marking hard workpieces such as iron or steel and heavy force must be applied by the marking tool to the workpiece. Under such force irregularities on the surface of the workpiece tend to shift the marking wheel engaged therewith circumferentially. This is typically true for example, in the case of metal castings which have inherently rough surfaces. If the direction of this shifting is retrograde, the radial shoulder on the wheel not infrequently exerts sufficient force against the radial shoulder on the retainer pawl to break the shoulder loose, thereby destroying the pawl. If the circumferential shifting is in the advancing or forward direction of the wheel, the extent of shifting can be sufficient so that upon the subsequent wheel-advancing movement of the actuating pawl the pawl misses the intended abutment at the forward end of the recess and fails to turn the marking wheel. Additionally, the pointed tip of the actuating pawl is relatively fragile and subject to breakage.

The object of the present invention is to provide a relatively simple, inexpensive marking tool structure improved to eliminate the above described breakage and malfunctioning of the conventional marking tool. One form of the invention is shown in the accompanying drawings wherein:

FIG. 3 is a side elevational view of the marking head with portions broken away and shown in section to illustrate structural detail.

FIG. 7 is a fragmentary generally elevational view illustrating the relation between a retaining pawl and a marking wheel.

FIG. 8 is an enlarged scale fragmentary elevational view of a marking wheel showing alternative forms of a structural detail in solid and dotted lines.

Figure 1:
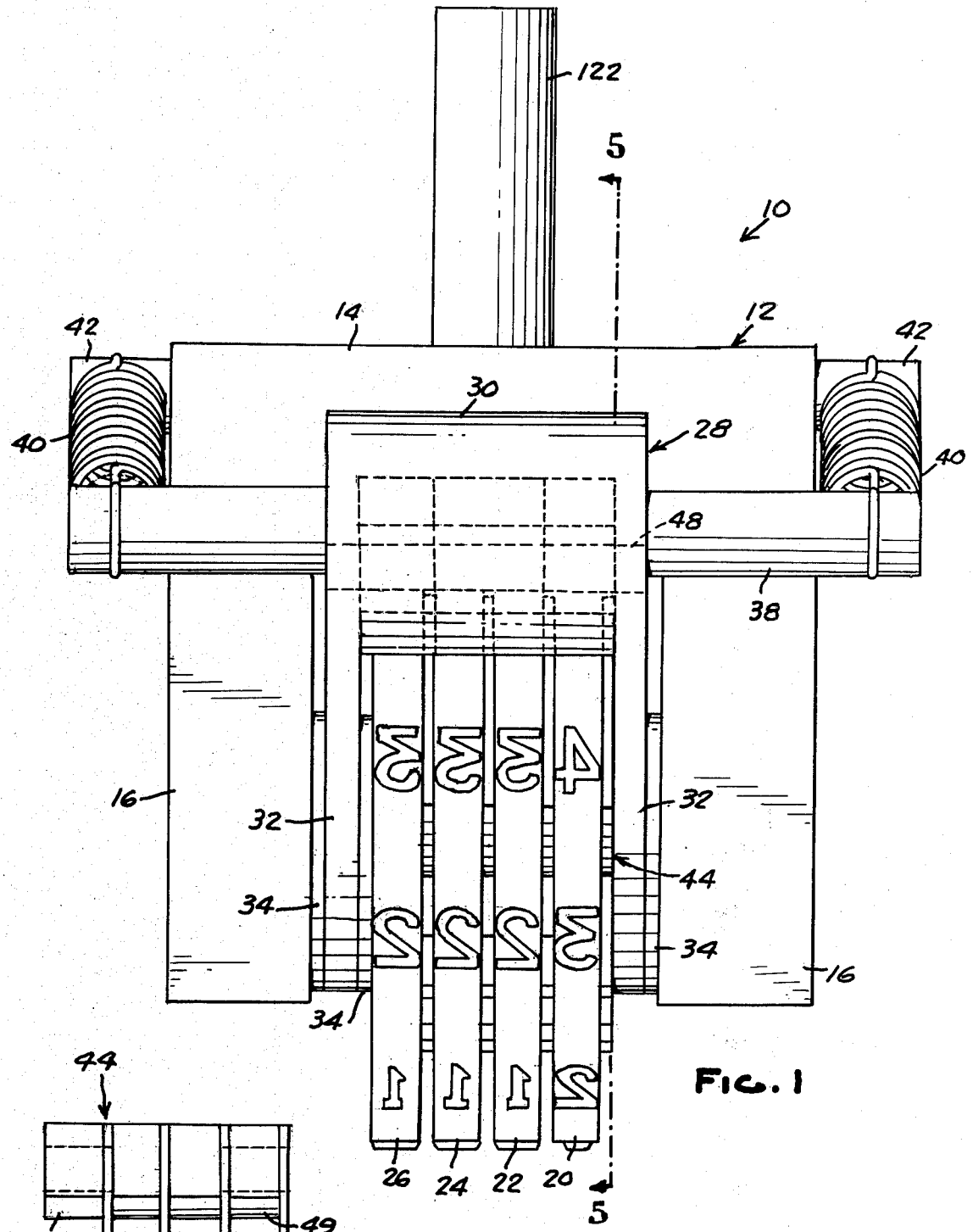
FIG. 1 is a front elevational view of a marking head which incorporates the present invention.

Shown in the drawings is a marking head 10 having a U-shaped frame 12 with a base 14 and two spaced apart legs 16 projecting therefrom. A shaft 18 is mounted on and extends between legs 16 generally parallel to base 14. A plurality of numbering or marking wheels 20,22,24 and 26 are mounted on shaft 18 for rotation relative to frame 12. Each wheel is provided with a circumferential array of marking symbols and in the illustrated marking head, these symbols comprise the numerals 0 through 9 inclusive as shown. When the wheels are appropriately indexed in a known manner, a succession of workpieces can be serially numbered from 0000 to 9999.

Figure 2:
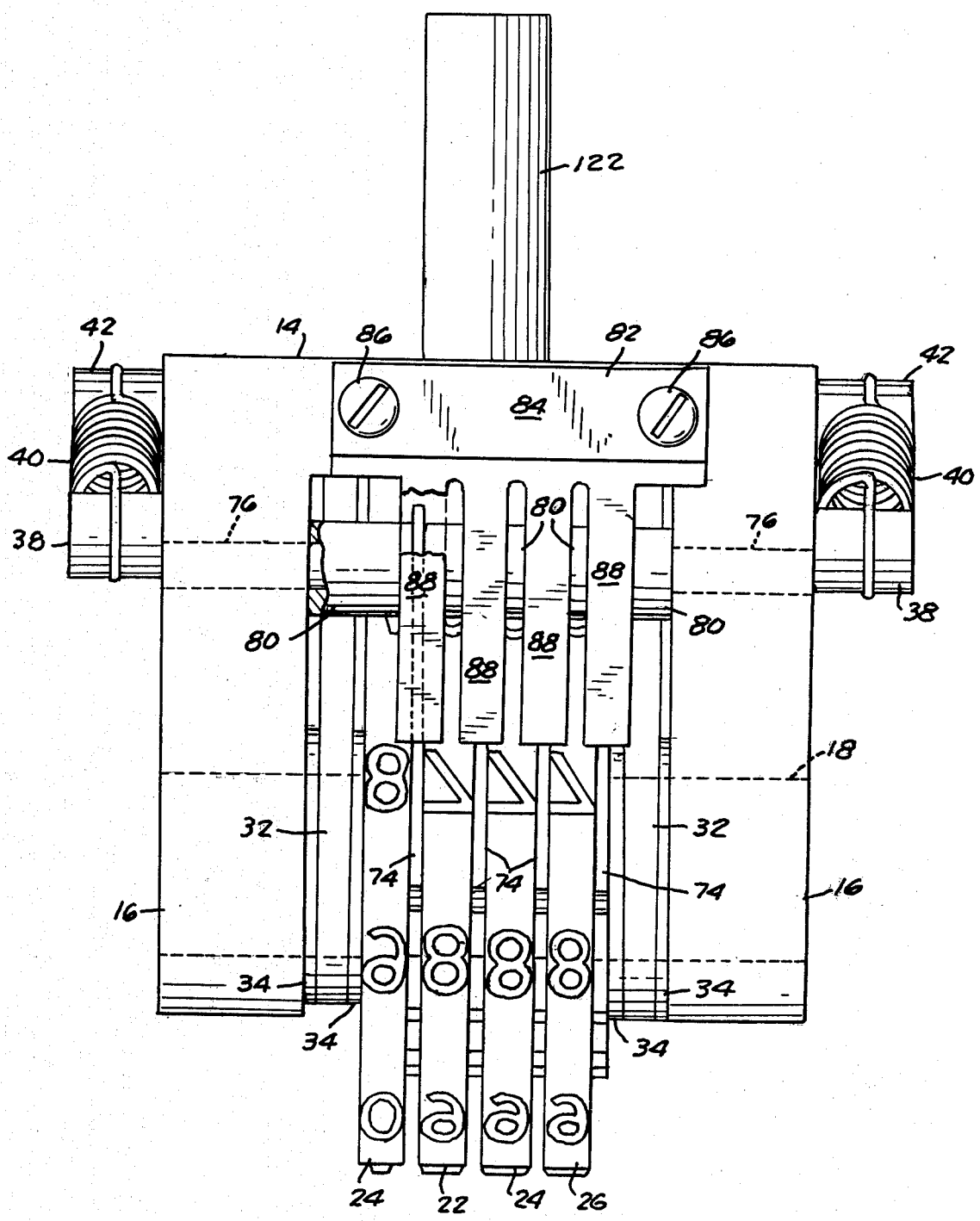
FIG. 2 is a rear elevational view of the marking head.

A carrier 28 has a head 30 which is swingably supported relative to frame 12 by spaced apart arms 32 engaged around shaft 18. Arms 32 straddle wheels 20–26 as shown in FIGS. 1 and 2. Spacers 34 are shown as being provided variously between carrier arms 32, frame legs 16 and the numbering wheels. These spacers can comprise bosses on arms 32, washers or the like. Head 30 has an opening 36 through which a rod 38 extends. This rod projects laterally away from each side of head 30 to form a yoke for attachment to a pair of tensioned coil springs 40 anchored on extensions 42 of frame 12.

An actuating pawl 44 is swingably mounted within a cut-away portion 46 of carrier head 30 by means of a pin 48 on the head rotatably engaged by a pair of apertured lugs 49 on pawl 44. Pawl 44 has a plurality of actuating fingers 50,52,54 and 56, one for each numbering wheel 20–26. Pawl 44 and its fingers 50–56 are biased radially inwardly of numbering wheels 20–26 by means of a torsion coil spring 58 having ends 60,62 respectively engaged against cut-away surface 46 of carrier head 30 and a surface portion 64 of pawl 44.

Figure 4:
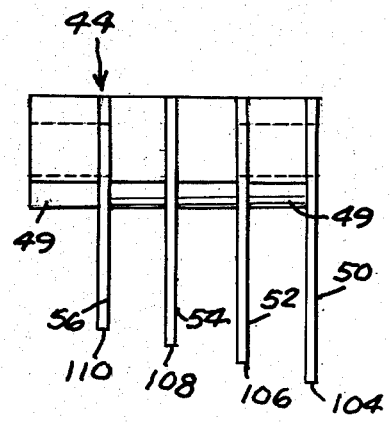
FIG. 4 is an elevational view of an actuating pawl taken in the direction of arrow 4 in FIG. 3.
Figure 6:
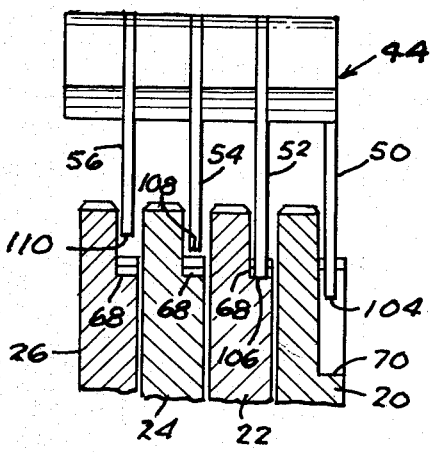
FIG. 6 is a fragmentary view partly in elevation and partly in section illustrating the relation between the actuating pawl and the numbering wheels.

As is conventional, pawl fingers 50–56 have progressively shorter lengths as shown in FIGS. 4 and 6. Also as is conventional, each wheel 20–26 carries on one side face a cam wheel 66 having for each marking symbol but one a relatively shallow radially inward recess 68 and having a single relatively deeper radial recess 70. Thus, in the structure illustrated, each cam wheel 66 has nine relatively shallow recesses 68 and one deeper recess 70. Where only four numbering wheels are used, wheel 26 can have ten recesses 68 and no deep recess 70 though for convenience in manufacture all cam wheels 66 are made substantially identical.

Figure 5:
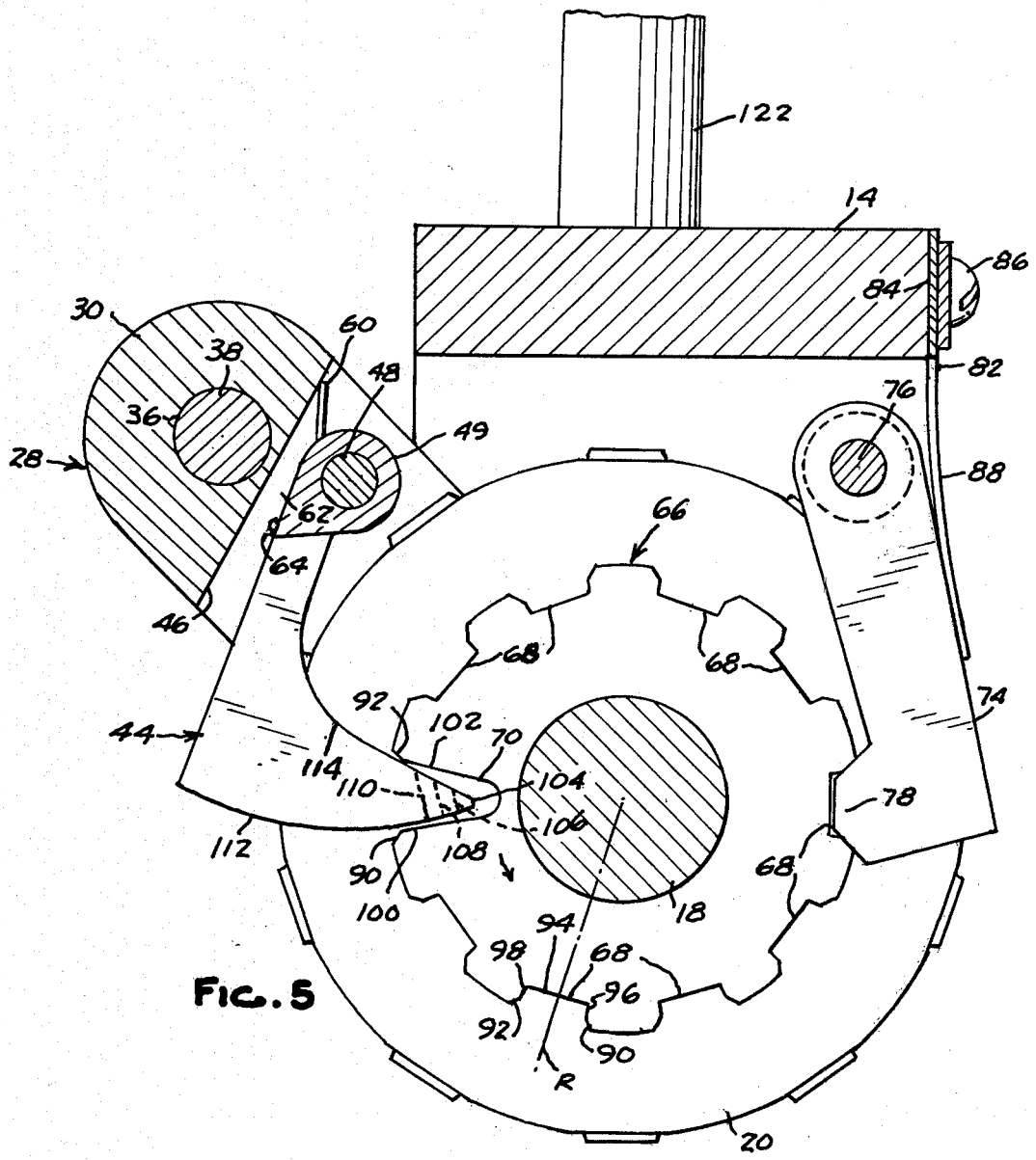
FIG. 5 is a sectional view on line 5—5 in FIG. 1, the actuating pawl being shown in a position different from FIG. 3.

The general mode of operation of carrier 28 and pawl 44 is also conventional. Each time carrier 28 is moved downwardly or counterclockwise as the drawings are viewed by a suitable actuator 72 (FIG. 3) pawl finger 50 by engagement within a recess 68 or 70 advances wheel 20 on one step to bring a marking numeral into alignment with a workpiece. During the first nine cycles of operation, pawl finger 50 engages within a shallow recess 68 which holds pawl fingers 52–56 out of engagement with the recesses 68,70 in their respective wheels. In the tenth cycle of operation pawl finger 50 drops into deeper recess 70 permitting pawl finger 52 to engage within a recess 68 in the cam wheel 66 carried by wheel 22 (FIGS. 3 and 6). In the tenth advancing step of wheel 22, pawl finger 52 drops into its respective deeper recess 70 permitting pawl finger 54 to engage within a recess 68 in the cam wheel 66 for wheel 24 for advancing wheel 24 one step. Similarly, in the tenth advancing step of wheel 24, pawl finger 54 drops into its respective deep recess 70 permitting pawl finger 56 to engage within a shallow recess 68 in the cam wheel 66 carried by wheel 26 whereby to advance wheel 26 one step (FIG. 5).

After each advancing movement of carrier 28, the force of actuator 72 is relieved and coil springs 40 retract carrier 28 upwardly or clockwise as the drawings are viewed to return the pawl 44 to its starting position preparatory to a subsequent cycle of operation. In this return stroke, pawl fingers 50–56 are cammed out of whatever recesses they may be engaged in against the action of torsion spring 58. In the terminal portion of this return movement, spring 58 snaps pawl 44 counterclockwise as FIGS. 3 and 5 are viewed to engage one or more of the pawl fingers into an awaiting recess 68 or 70.

A plurality of retainer pawls 74, one for each wheel 20–26, are swingably mounted on frame 12 by such means as a pin 76 extending between frame legs 16. Cam wheels 66 on numbering wheels 20–26 form spacers which keep the radially outward portions of adjacent numbering wheels in axially spaced relation. Pawls 74 extend into these axial spaces and each pawl 74 has a nose portion 78 which is cam-shaped for cooperation with recesses 68,70 as is brought out in greater detail below. Spacers 80 are provided around pin 76 and between pawls 74 to assist in keeping these pawls in axial alignment with cam wheels 66. A comb-shaped leaf spring 82 has a head 84 secured to frame base 14 by suitable means such as screws 86. A spring leaf 88 projects from head 84 into engagement with each pawl 74 for biasing the pawl radially inwardly of a cam wheel 66.

The present invention lies in the structure of recesses 68,70, actuating pawl 44, retaining pawls 74 and the cooperation between these features. In accordance with the invention, each recess 68 has, with respect to the direction of advancement of a marking wheel, a forward cam surface 90 and a rearward cam surface 92, these surfaces extending in opposite directions relative to a radius R of the wheel passing through the recess. These angles are in the range of about 30° to about 60°. In a typical marking tool according to the invention, these angles are nominally 45° and as a practical matter, are about 45° plus or minus one degree.

Each recess 68 has a bottom 94 and a pair of shoulders 96,98 which respectively extend from the inner ends of cam surfaces 90,92 to recess bottom 94. Each forward shoulder 96 extends at an angle of from about 10° to about 12° relative to radius R. Typically, the angle between shoulder 96 and radius R is about 11°. Functionally, shoulders 98 need not be limited to this angular orientaation. However, for convenience of design and manufacture, they are typically disposed at about the same angle to radius R as shoulders 96. For convenience of manufacture, recess bottom 94 extends either chordally (solid line, FIG. 8) or circumferentially of the respective marking wheel. In either case, bottom 94 for all practical purposes can be considered substantially flat. Each deep recess 70 also has forward and rearward cam surfaces 90,92 which respectively adjoin forward and rearward sides 100,102, side 100 being angled to a radius passing centrally through recess 70 at about 11° similarly to forward shoulder 96 of recesses 68.

Fingers 50–56 of actuating pawl 44 have respectively relatively flat blunt end faces 104–110. The forward edges of pawl fingers 50–56 are all curved on a similar relatively large radius, typically about the axis of rotation of pawl 44, so that each finger 50–56 presents a relatively blunt forward face represented at 112. The rearward edges of pawl fingers 50–56 likewise have similar curvature as represented at 114 for a purpose to be described.

Nose portion 78 of each retainer pawl 74 has forward and rearward cam surfaces 116,118 shaped complementally to cam surfaces 90,92 in cam recesses 68,70. Nose 78 also has an end face 120 extending between cam surfaces 116,118, this end face being at least slightly spaced from bottom 94 of a recess 68 when cam surfaces 116,118 are engaged with cam surfaces 90,92 thereof.

In use, it may be assumed that marking head 10 has been mounted on a marking machine by such means as a mounting shaft 122 projecting from base 14 of frame 12. Actuator 72 is in its rest position and carrier 28 has been retracted to its upward position by coil springs 40. In the position of the parts shown in solid lines in FIG. 3 and in FIG. 6, pawl finger 50 has completed nine indexing steps of marking wheel 20 and has entered deep recess 70. Pawl 44 is thereby enabled to swing radially inwardly under the impetus of spring 58 to engage end face 106 of pawl finger 52 against bottom 94 of a recess 68 in its cam wheel 66. Ends 108 and 110 of fingers 54 and 56 are disengaged from the recesses in their respective cam wheels 66. Nose 78 of each retainer pawl 74 is radially aligned with a recess 68 and cam surfaces 116,118 are engaged against cam surfaces 90,92 of the recess under the bias of springs 88.

Assuming that marking head 10 is positioned out of engagement with a workpiece, when actuator 72 is actuated it swings carrier 28 downwardly or counterclockwise as the drawings are viewed thereby carrying actuating pawl 44 in an arc around the axis of shaft 18 from the solid line position to the dotted line position of FIG. 3. The blunt forward faces 112 of pawl fingers 50 and 52 respectively engage surface 100 and shoulder 96 of the recesses in their respective cam wheels 66 to advance numbering wheels 20,22 one step, for example, from 0009 to 0010 (or, for example, from 0999 to 1000 in the FIG. 5 position of pawl 44). During this movement, retaining pawls 74 are cammed radially outwardly against the bias of springs 88 by relative movement of cam surfaces 92 and 118. At the end of this movement, pawls 74 are snapped into the succeeding recess 68 by springs 88.

Actuator 72 is then retracted and carrier 28 is swung upwardly or clockwise as the drawings are viewed thereby returning pawl 44 from the dotted line position to the solid line position of FIG. 3. During this movement, pawl 44 is shifted radially outwardly by engagement of rear surfaces 114 of pawl fingers 50,52 with cam surfaces 92 on their respectively engaged recesses 70 and 68. The numbering wheels are secured against retrograde rotation during this return movement by engagement of retainer pawls 74 within recesses 68 or 70 in their respective cam wheels 66. At the end of this return movement, actuating pawl 44 is snapped radially inwardly by spring 58 and flat end face 104 of pawl finger 50 engages against the substantially flat bottom 94 of the succeeding recess, in this case, a recess 68.

Because of the relatively large radius of curvature of forward surfaces 112 of pawl fingers 50–56 on the one hand the angular orientation of recess shoulders 96,100 on the other hand, at and immediately adjacent their location of interengagement, surfaces 112 and shoulders 96,100 extend very nearly in the same direction and as a practical matter, can be considered to be generally parallel. Thus, these surfaces for practical purposes can be considered to be in substantially flat interengagement. Also, the blunt flat end faces 104–110 of pawl fingers 50–56 respectively engage bottoms 94 of recesses 68 either flatly or so nearly flatly that for practical purposes, their interengagement can be considered flat. With this structure, pawl fingers 50–56 can be made very strong, are minimally subject to breakage and are virtually immune from damage during normal use.

After a marking numeral has been carried into position by cycling carrier 28, marking head 10 is advanced toward the workpiece (downwardly as the drawings are viewed) and the numeral is pressed against the workpiece usually under heavy pressure. Any irregularities on the surface of the workpiece tend to rotate one or more of marking wheels 20–26. Should a wheel shift retrograde or clockwise as the drawings are viewed, cam surface 90 in recess 68 (or 70) by engagement with cam surface 116, cams the respective retainer pawl 74 radially outwardly against the bias of spring 88. FIG. 7 illustrates the condition of the parts when a marking wheel has been shifted retrograde through an angle A. Similarly, if a wheel should be rotatably shifted in a forward direction, that is, counterclockwise as FIG. 7 is viewed, pawl 74 would be cammed outwardly by movement of cam surface 92 relative to cam surface 118 on the pawl.

When the marking force is relieved by retracting marking head 10 away from the workpiece, interengagement of cam surfaces 90,116 or 92,118 under the impetus of spring 88 causes the wheel to return to its properly centered position wherein both sets of cam surfaces are interengaged as in FIGS. 3 and 5. To achieve this re-centering function reliably in use, cam surfaces 90,116 on the one hand and 92,118 on the other hand have such a length that they remain respectively interengaged through rotation of their respective numbering wheels through a circumferential extent which is about ½ the circumferential extent of a marking numeral or symbol on the marking wheel. This circumferential extent is up to about 4.5% of the diameter of the wheel.

The importance of permitting pawls 74 to be cammed outwardly upon retrograde shifting of a numbering wheel is to eliminate the breakage of the retaining pawls which occurs in conventional marking heads. The importance of the re-centering function of pawls 74 and the two sets of cam surfaces 90,116 and 92,118 is to insure that upon the subsequent advancing stroke of actuating pawl 44 recesses 68 or 70 will be properly circumferentially positioned for engagement by their respective fingers 50–56 for advancing their respective numbering wheels. Such re-centering is not possible in conventional marking heads. Breakage of pawl fingers 50,56 upon retrograde shifting of numbering wheels 20,26 is seldom a problem since carrier 28 and pawl 44, subsequent to wheel advancing movement, retract through an angle several degrees greater than the angle through which the wheels are advanced, thereby providing clearance between forward end faces 112 of the pawl fingers and shoulders 96,100 in recesses 68,70 adequate to accommodate such shifting.

I claim:

1. In a marking head having a frame which supports a shaft, at least one marking wheel on said shaft rotatable relative to said frame to align successive circumferentially arrayed marking portions thereon with workpieces, a cam wheel operably connected with each said marking wheel for rotation therewith and having a circumferential series of radially inward recesses, one for each said marking portion, a retainer pawl carried by said frame and being releasably engageable under a spring bias with successive recesses to retain successive marking portions in workpiece alignment, and actuating means carried by said frame and engageable successively with said recesses to advance successive marking portions into said alignment, improved structure wherein each said recess has two surface portions spaced circumferentially apart, said surface portions extending along lines disposed at opposite angles relative to a radius of said cam wheel passing between said surface portions, said retainer pawl having surface portions configured and oriented to engage said surface portions of said recess along said lines when said retainer pawl is engaged in said recess, said surface portions when interengaged being relatively movable along a said line to facilitate rotation of said marking wheel under the influence of force on a said marking portion incidental to engagement with a workpiece, said angles and the length of interengagement of said surface portions being so correlated that one pair of said interengaged surface portions remains interengaged despite said rotation in either direction by about one-half the circumferential extent of a said marking portion, said spring bias and one pair being cooperable to return said marking wheel through said circumferential extent responsive to relief of said force, and said actuating means has a forward edge face normally extending into one of said recesses and disengaged from said one recess to provide a clearance between said forward edge face and said recess when both of said retainer pawl surface portions are each simultaneously interengaged with their associated one of said two surface portions of another recess engaged by said retainer pawl, whereby retrograde rotation of said marking wheel within predetermined limits in response to force on a marking portion incidental to its engagement with a workpiece does not apply force to said actuating means thereby avoiding breakage of said actuating means.

2. The structure defined in claim 1 wherein said angles are substantially equal.

3. The structure defined in claim 2 wherein said angles are in the range of about 30° to about 60°.

4. The structure defined in claim 3 wherein said angles are substantially 45°.

5. The structure defined in claim 3 wherein said angles are 45° plus or minus 1°.

6. The structure defined in claim 1 wherein said circumferential extent is up to about 4.5% of the diameter of said marking wheel.

7. The structure defined in claim 1 wherein said recess has a bottom which extends between said surface portions thereof, each retainer pawl having a radially inward face extending between said surface portions thereof, said face being spaced radially outwardly of said bottom when said surface portions are interengaged.

8. The structure defined in claim 7 wherein said angles are 45° plus or minus 1°, said circumferential extent being up to about 4.5% of the diameter of said marking wheel.

9. In a marking head having a frame which supports a shaft, at least one marking wheel on said shaft rotatable relative to said frame to align successive circumferentially arrayed marking portions thereon with workpieces, a cam wheel operably connected with each said marking wheel for rotation therewith and having a circumferential series of radially inward recesses, one for each said marking portion, a retainer pawl mounted on said frame and being releasably engageable under a spring bias with successive recesses to retain successive marking portions in workpiece alignment, and actuating means engageable successively with said recesses to advance successive marking portions into said alignment, improved structure wherein, each said recess has two surface portions spaced circumferentially apart, said surface portions extending along lines disposed at opposite angles relative to a radius of said cam wheel passing between said surface portions, said retainer pawl having surface portions configured and oriented to engage said surface portions of said recess along said lines when said retainer pawl is engaged in said recess, said surface portions when interengaged being relatively movable along a said line to facilitate rotation of said marking wheel under the influence of force on a said marking portion incidental to engagement with a workpiece, said angles and the length of interengagement of said surface portions being so correlated that one pair of said interengaged surface portions remains interengaged despite said rotation in either direction by about one-half the circumferential extent of a said marking portion, said spring bias and one pair being cooperable to return said marking wheel through said circumferential extent responsive to relief of said force, at least certain of said recesses having a bottom which extends between said surface portions thereof, said bottom having a forward end with respect to the direction of advancement of said marking wheel, the forward one of said surface portions of each recess having an inner end, and a generally flat rearwardly facing shoulder extending between said forward end and inner end, said actuating means having an end face and a blunt forward face, said end face and forward face being engaged respectively with said bottom and shoulder when said actuating means is positioned for advancing said marking wheel.

10. The structure defined in claim 9 wherein said bottom extends in a generally circumferential direction of said cam wheel.

11. The structure defined in claim 9 wherein said bottom extends in an essentially chordal direction of said cam wheel.

12. The structure defined in claim 9 wherein said shoulder, between said ends, extends along a line disposed at an acute angle to a radius of said cam wheel passing through said bottom portion, said forward face having a portion which extends generally parallel to the latter said line when said actuating means is so positioned.

13. The structure defined in claim 12 wherein said radius passes through substantially the midpoint of said bottom.

14. The structure defined in claim 12 wherein said acute angle is in the range of about 10° to about 12°.

15. The structure defined in claim 14 wherein said acute angle is about 11°.

16. The structure defined in claim 13 wherein said forward face of said actuating means comprises an arcuate portion engageable with said shoulder and immediately adjacent surface portion of said recess.

17. The structure defined in claim 9 wherein said recesses have rearward portions which comprise a rearward end of said bottom, the rearward of said surface portions and an inner end thereof, and a generally flat forwardly facing shoulder extending between said rearward end and inner end of said rearward surface portion, said rearward portions of said recess thus comprised being respectively disposed substantially symmetrically to said forward end, said forward surface portion and inner end thereof, and said rearwardly facing shoulder.

18. The structure defined in claim 12 wherein said bottom extends in a direction generally circumferential of said cam wheel, said radius passing through substantially the midpoint of said bottom, said angles of said surface portions being substantially 45°, said circumferential extent being up to about 4.5% of the diameter of said wheel, each retainer pawl having a radially inward face extending between said surface portions thereof, said face being spaced radially outwardly of said bottom when said surface portions are interengaged.

19. A marking head comprising a frame, at least one marking wheel rotatably carried by said frame to align successive circumferentially arrayed marking portions thereon with workpieces, a cam wheel operably connected with each marking wheel for rotation therewith and having a circumferential series of recesses with one recess for each said marking portion, a retainer pawl carried by said frame and yieldably biased for releasable engagement with successive recesses to retain successive marking portions in workpiece alignment, each said recess having two surface portions spaced apart circumferentially and extending along lines disposed at opposite angles relative to a radius of said cam wheel passing between said surface portions, said retainer pawl having surface portions configured and oriented to engage said surface portions of said recess along said lines when said retainer pawl is engaged in said recess, said surface portions of said recess and pawl when interengaged being relatively movable along their associated said line to permit rotation of said marking wheel under the influence of force on a said marking portion incidental to its engagement with a workpiece, said angles and the length of interengagement of said pawl and said recess surface portions being so correlated that one pair of interengaged surface portions remains interengaged despite said rotation of said marking wheel in either direction by about one-half the circumferential extent of a said marking portion, said bias of said retainer pawl and one pair of interengaged surface portions being cooperable to return said marking wheel through said circumferential extent in response to relief of said force, actuating means having a forward face extendable generally radially into and engageable with said recesses to advance successive marking portions of said marking wheel into said workpiece alignment, each recess having a forward shoulder constructed and arranged for engagement with a forward face of said actuating means for cooperation with said actuating means to rotate said marking wheel to advance a marking portion into said workpiece alignment, said forward shoulder of each recess extending generally radially of said cam wheel and being disposed radially inward of and adjacent to the forward one of said surface portions of said recess, a forward edge surface of said actuating means and said shoulder of each said recesses being constructed and arranged so that, when both of said retainer pawl surface portions are simultaneously interengaged with their associated one of said two surface portions of a recess engaged by said retainer pawl and a forward edge face of said actuating means extends radially into another of said recesses, there is a clearance between said forward edge face and said forward shoulder of said another recess, whereby retrograde rotation of said marking wheel within predetermined limits in response to force on a marking portion incidental to its engagement with the workpiece does not apply a force to said actuating means, thereby avoiding breakage of said actuating means.

20. The marking head of claim 19 wherein said forward shoulder is disposed at an acute angle not greater than about 12° to a radius of said cam wheel passing through the center of said recess between its associated surface portions.

21. The marking head of claim 20 wherein said acute angle is in the range of about 10° to 12°.

22. In a marking head having a frame which supports a shaft, at least one marking wheel on said shaft rotatable relative to said frame to align successive circumferentially arrayed marking portions thereon with workpieces, a cam wheel operably connected with each said marking wheel for rotation therewith and having a circumferential series of radially inward recesses, one for each said marking portion, a retainer pawl carried by said frame and being releasably engageable under a spring bias with successive recesses to retain successive marking portions in workpiece alignment, and actuating means having an operable connection with each said wheel for turning the same in successive increments of movements to advance successive marking portions into said alignment, improved structure wherein, said actuating means has an actuated condition in which it so turns at least one said wheel, said actuating means having a deactuated condition in which it discontinues said movement, each said marking wheel and said actuating means, in said deactuated condition of said actuating means, being constructed and arranged to freely rotate in either direction through about one-half the circumferential extent of a said marking portion under the influence of force on a said marking portion incidental to engagement with a workpiece such that retrograde rotation thereof within predetermined limits does not apply a force to said actuating means and thereby avoids breakage of said actuating means, each said recess having two surface portions spaced circumferentially apart, said surface portions extending along lines disposed at opposite angles relative to a radius of said cam wheel passing between said surface portions, said retainer pawl having surface portions configured and oriented to engage said surface portions of said recess along said lines when said retainer pawl is engaged in said recess, said surface portions when interengaged being relatively movable along a said line to facilitate rotation of said marking wheel under the influence of said force, said angles and the length of interengagement of said surface portions being so correlated that one pair of said interengaged surface portions remains interengaged despite said rotation in either direction by about one-half the circumferential extent of a said marking portion, said spring bias and one pair being cooperable to return said marking wheel through said circumferential extent responsive to relief of said force.

* * * * *